US012588698B2

(12) United States Patent
Lawson et al.

(10) Patent No.: US 12,588,698 B2
(45) Date of Patent: Mar. 31, 2026

(54) AEROSOLIZABLE NICOTINE-CONTAINING FORMULATIONS

(71) Applicant: Ventus Medical Limited, Liverpool (GB)

(72) Inventors: David Lawson, Liverpool (GB); Mark Dignum, Liverpool (GB)

(73) Assignee: Ventus Medical Limited, Liverpool (GB)

( * ) Notice: Subject to any disclaimer, the term of this patent is extended or adjusted under 35 U.S.C. 154(b) by 373 days.

(21) Appl. No.: 18/271,646

(22) PCT Filed: Dec. 22, 2021

(86) PCT No.: PCT/EP2021/087213
§ 371 (c)(1),
(2) Date: Jul. 10, 2023

(87) PCT Pub. No.: WO2022/152529
PCT Pub. Date: Jul. 21, 2022

(65) Prior Publication Data

US 2025/0261680 A1 Aug. 21, 2025

(30) Foreign Application Priority Data

Jan. 12, 2021 (GB) ..... 2100353

(51) Int. Cl.
*A24B 15/167* (2020.01)
*A24B 15/24* (2006.01)
(Continued)

(52) U.S. Cl.
CPC ..... *A24B 15/167* (2016.11); *A24B 15/243* (2013.01); *A24B 15/301* (2013.01); *A24B 15/32* (2013.01)

(58) Field of Classification Search
CPC ... A24B 15/243; A24B 15/167; A24B 15/301; A24B 15/32
See application file for complete search history.

(56) References Cited

U.S. PATENT DOCUMENTS

| | | | |
|---|---|---|---|
| 4,830,028 | A | 5/1989 | Lawson |
| 9,215,895 | B2 | 12/2015 | Bowen et al. |
| 2014/0345631 | A1 | 11/2014 | Bowen et al. |

FOREIGN PATENT DOCUMENTS

| | | | |
|---|---|---|---|
| CN | 108887731 | A | 11/2018 |
| CN | 109619655 | A | 4/2019 |

(Continued)

OTHER PUBLICATIONS

English translation of CN-108887731, European patent office,[online],retrieved from the Internet,[retrieved Sep. 15, 2025], <URL:https://worldwide.espacenet.com/patent/search/family/064354998/publication/CN108887731A?q=CN%20108887731 (Year: 2025).*

(Continued)

*Primary Examiner* — Dennis R Cordray
(74) *Attorney, Agent, or Firm* — John H. Choi & Associates

(57) ABSTRACT

Nicotine-containing formulations for electric/electronic nicotine delivery systems are disclosed, containing both nicotine at relatively much higher concentrations, typically at least 25% by weight of total formulation weight, w/w, and in many cases as much as 40-50% w/w, than is typical for conventional nicotine containing formulations, which only contain about 2-4% w/w nicotine. The formulations also include a biologically and pharmaceutically acceptable mono- or di-carboxylic organic acid, such as benzoic acid, salicylic acid and most preferably lactic acid also at relatively high w/w concentrations. One or more nicotine salts may be created and be extant within the formulations, which (Continued)

not only mitigates against the loss of nicotine to the atmosphere through natural volatility and evaporation, but also markedly increases the surface energy of the formulations created, and the globules of formulations deposited on a heating substrate are much more cohesive and much less likely to migrate through wetting over the substrate.

17 Claims, 3 Drawing Sheets

(51) Int. Cl.
*A24B 15/30* (2006.01)
*A24B 15/32* (2006.01)

(56) References Cited

FOREIGN PATENT DOCUMENTS

| | | | |
|---|---|---|---|
| CN | 110477442 | A | 11/2019 |
| WO | 2019068780 | A1 | 4/2018 |
| WO | 2018167166 | A1 | 9/2018 |
| WO | 2019137982 | A1 | 7/2019 |
| WO | 2019137994 | A1 | 7/2019 |
| WO | 2019141577 | A1 | 7/2019 |

OTHER PUBLICATIONS

English translation of CN-110477442, Google patents,[online],retrieved from the Internet,[retrieved Sep. 15, 2025], <URL:https://worldwide.espacenet.com/patent/search/family/068554456/publication/CN110477442A?q=CN%20110477442 (Year: 2025).*

Kallio et al, Sugars and acids of strawberry varieties, Eur Food Res Technol (2000) 212 :81-85,[online],retrieved from the Internet,[retrieved Sep. 15, 2025],<URL:https://link.springer.com/article/10.1007/s002170000244> (Year: 2000).*

European Patent Office, International Preliminary Examining Authority, International Preliminary Report on Patentability, Int'l App. No. PCT/EP2021/087213, Apr. 10, 2020.

European Patent Office, International Search Report, Int'l App. No. PCT/EP2019/087213, Jun. 15, 2022.

* cited by examiner

AEROSOLIZABLE NICOTINE-CONTAINING FORMULATIONS

FIELD OF THE INVENTION

The present invention relates broadly to a range of different nicotine-containing formulations adapted for use with a specific type of electronic cigarette or similar aerosolising or vaporising appliance, hereinafter referred to as a "vaping" device or devices. More particularly, the present invention relates to a range of nicotine-containing formulations in which the concentration of nicotine may be comparably considerably higher than that in the vast range of nicotine-containing formulations currently available and adapted for use with the similarly broad range of conventional vaping devices.

BACKGROUND TO THE INVENTION

Nicotine-containing formulations for use with reservoir-based vaping devices are already widely available. Indeed, as the popularity of vaping devices of all kinds has exploded in recent years, so too has the availability and variety of the nicotine-containing liquid formulations they utilise, to the extent that there are now many thousands of different formulations. Despite this proliferation, the underlying composition and chemistry of nicotine-containing formulations is relatively straightforward, because in essence, any and all liquid formulations, at least those intended for use in the conventional "wick-and-coil" devices, must (1) be easily aerosolisable, and (2) contain sufficient nicotine so that each and every aerosol produced by the device also contains a sufficient amount of nicotine to deliver a "hit" to a user when inhaled. To expand further on the constituents of modern formulations, liquid formulations will generally always contain:

1. A pharmaceutically acceptable aerosolisable component or "excipient", and
2. Nicotine itself, and/or some complex, derivative, or conjugate thereof (e.g. various salts of nicotine have become popular in recent times), or some other chemical constituent, complex, derivative or system from which nicotine itself and/or some complex or conjugate thereof is capable of being released when heated or otherwise excited.

Additionally, many modern formulations may contain a small percentage of water, and often will contain one or more flavouring agents, again in typically relatively low concentrations as regards the overall composition of the formulation. Naturally, there are a vast array of different flavouring agents, but common flavouring compounds include safrole, ethyl vanillin, camphor, α-thujone, menthol, and coumarin, to name but a few.

As regards (1) above, examples of suitable and already in-use excipients are: Glycerol, Vegetable Glycerin (VG), Propylene Glycol (PG), Polyethylene Glycol (PEG), trimethylene glycol (TMG), or some combination of two or more of these. One particularly common excipient is some combination of PG & VG, e.g. 10-90% PG with 90-10% VG, although pure VG- and pure PG-based formulations are also known.

As regards (2) above, the vast majority of current formulations simply involve only nicotine itself, either synthetically manufactured, or extracted directly from tobacco itself, at very high purity levels (e.g. <1% contaminants). Typical concentrations of nicotine in most common formulations range anywhere from 2-4 mg/ml of formulation up to 60 mg/ml, although increasingly Regional and National Governments are introducing restrictions on the maximum nicotine concentration levels which can legally be sold in the territories they govern. For example, the European Tobacco Products Directive (EUTPD) (2014/40/EU), implemented widely throughout Europe in 2015/2016, essentially restricts the capacity of e-cigarette refill tanks to no more than 2 ml and the maximum volume of e-liquids containing nicotine (for retail sale) for one refill container to 10 ml. Furthermore, the Directive limits the nicotine concentration of formulations (also known widely as "e-liquids" or "vape juices", or simply "juices") to no more than 20 mg/ml, and also requires that products containing nicotine and their packaging be generally tamper proof and particularly resistant to child tampering.

More recently, it has been proposed (see especially U.S. Pat. No. 9,215,895 in the name of Juul Labs Inc.) to create formulations which include one or more salts of nicotine, instead of nicotine in its freebase or pure state. Indeed, formulations including salts of nicotine (so called "Nic Salts") have recently (in the last 2-3 years) become almost as widespread as pure nicotine-containing formulations discussed above. To explain further, manufacturers of cigarettes and other conventional tobacco products (CTPs), commonly known in industry circles as "Big Tobacco", have long known that salts of nicotine are not only already present in tobacco leaves, but also that certain nicotine salts could usefully be used as additives to conventional tobacco to make it more palatable to users (i.e. Nicotine Salts generally lower the pH of the smoke/vapour generated by a lit cigarette, effectively reducing the "throat hit" experienced by smokers during inhalation). [See in particular U.S. Pat. No. 4,830,028 to R J Reynolds Tobacco Company and mentioning Thomas Perfetti as inventor, who conducted Reynolds Tobacco's original research into Nicotine Salts in 1978].

According to Juul Labs INC. US patent above, nicotine salt formulations are ideally made relatively simply, for example by adding pure nicotine, which in chemical terms is a base, to a suitable organic carboxylic or di-carboxylic acid, e.g. benzoic acid, in the correct proportions to give a (liquid) formulation including both the nicotine salt (resulting from the reaction of the acid with the nicotine base), together with some residual freebase nicotine at a desired concentration level. This formulation is then mixed with a suitable excipient, typically a PG-VG mixture, wherein the ratio by weight is 3:7 PG:VG such that, in the resulting formulation, the nicotine concentration is between 0.5-20% w/w of the final formulation, and ideally about 4% w/w. It is suggested in U.S. Pat. No. 9,215,895, that inhalation of aerosols created from such formulations results in increased efficiency of the transfer of nicotine to the lungs (as compared with conventional nicotine-containing formulations without nicotine salts), and this in turn results in a rapid rise of nicotine absorption in the blood plasma. Thus, most simply, the use of nicotine salts in formulations would appear to simultaneously increase palatability of inhaled aerosols generated therefrom, and decrease the time taken for a specific concentration of nicotine to be achieved within blood plasma, in turn decreasing the time taken between a user's first inhalation and his or her receiving the desired cerebral "hit" of the narcotic. Slightly more subtly, the Juul US patent potentially also teaches that the use of nicotine salts in nicotine-containing formations could also be one mechanism whereby the amount of nicotine contained within a formulation could be increased thus making it more potent in terms of the quantity of the drug delivered to the user, at least compared to a conventional formulation not containing nicotine salts, without significantly affecting palatability.

It is important in the context of the present invention to note from the above that the liquid formulations heretofore described remain suitable only for conventional wick-and-coil vaping devices (including "pod mod" or simply just "pod" cartridge-based devices), because such devices are designed generally to produce considerable quantities of voluminous, visible aerosols with relatively low concentrations of nicotine (about 0.1 mg in each aerosol or less), to mimic the smoking of a conventional cigarette as much as possible.

By contrast, the present invention is concerned with nicotine-containing formulations in which the nicotine concentrations are significantly higher than even the most nicotine-laden formulations currently available, and therefore the vast majority of current devices, whether cartridge-based, reservoir-based, would be wholly inappropriate, and possibly even dangerous. For example, even the most potent formulation currently available (albeit only outside Europe given the widespread adoption of TPD) has a nicotine concentration of only 7.5% w/w, whereas the present invention is concerned only with formulations in which the nicotine content is at least 20% w/w and in most instances even greater still.

Although the skilled person would rightly question why such high nicotine concentration formulations would ever be appropriate or useful, it is important to mention that even though it is widely accepted that vaping is far less detrimental to human health than smoking conventional tobacco products like cigarettes, there nevertheless remain significant health concerns surrounding vaping in general, and it is Applicant's fundamental contention that if one has to inhale anything foreign at all, then as little as possible of that or those foreign substances should be inhaled. Therefore, Applicant has designed a new, somewhat revolutionary cartridge-based vaping device wherein each cartridge is initially provided as a sealed package which is to be opened and unwrapped before insertion into the device, with each cartridge being equivalent to a single cigarette in terms of its usage profile within the device and the amount of formulation it contains, and in turn the amount of nicotine, present thereon. In contrast, most conventional reservoir-based devices, when filled with conventional nicotine-containing formulations, have a usage profile roughly equivalent to a pack of twenty cigarettes, and in some cases considerably more.

Thus each cartridge of Applicant's device is accurately and precisely pre-dosed with only a relatively tiny (3 mg or less) amount of the potent nicotine-containing formulation, and this is manifested usually in 1-4 tiny (1-4 mm diameter or possibly less) globules being deposited directly on one or other surface of the cartridge or a substrate within it. Thus by pre-dosing the cartridge in this way with a suitably high-concentration nicotine-containing formulation, and designing the heating aspects of the device appropriately (the heater is applied directly to the substrate within the cartridge) such that a precisely controlled amount of aerosol is created during any device single activation, Applicant's device is capable of being approved by medical and clinical regulatory bodies (e.g. MHRA in the UK) for use as a medical device because it is capable of delivering a desired target dose of a drug both accurately and repeatedly, and there is practically no possibility that an end user can tamper with the device so that it becomes dangerous in any way. As the skilled reader will understand, medically approved devices can, at least in the UK and in many countries of Europe, be prescribed by doctors as a treatment for the condition of nicotine addiction. Additionally, as the skilled reader will understand, because the concentration of nicotine in Applicant's desired formulations is relatively high, the actual volume of nicotine-containing aerosol created must necessarily be considerably less, possibly even one or more orders of magnitude less, than that typically created by any conventional vaping device utilising more conventional, lower nicotine concentration formulations. For the reasons mentioned above, this is of course highly advantageous and a much more medically attractive proposition, at least in terms of the likely detriment to health arising from inhalation of foreign substances.

For reference, the reader's attention is drawn to Applicant's own prior published patent applications covering various aspects of its device and the cartridges designed and adapted for use therein, in particular WO2019/137994, WO2018/167166, WO2019/141577, WO2019/068780, WO2019/137982.

Despite the benefits of using high concentration nicotine containing formulations, Applicant has nevertheless encountered various difficulties, particularly with formulations containing above 20% w/w nicotine. The first and most pervasive problem is one of chemical stability. Nicotine itself is a volatile liquid, and at the concentrations within aerosolisable formulations with which the present invention is concerned, the loss of nicotine to the ambient atmosphere through natural surface evaporation can be significant, and furthermore this loss increases exponentially with the concentration, so the higher the proportion of nicotine present in a formulation, the much greater the likelihood of loss through evaporation. Furthermore, nicotine is somewhat chemically aggressive, and although the base substrates on which the globules of formulation are deposited on in Applicant's cartridges are usually of glass or some other inert ceramic which would thus be generally resistant to absorbing, becoming impregnated with, or otherwise chemically interacting with the nicotine present in the formulation, often the base substrates are surrounded by or partially encased within plastics materials which, together with the substrate, constitute the cartridge as a whole. Applicants have found that, with certain plastics materials at least, nicotine can leach from the formulation into such materials, thus not only compromising the material but also materially reducing the amount of, and thus the concentration of, nicotine within the formulation. As the reader will appreciate, for a high accuracy drug delivery device intended to be subjected to rigorous testing during the medical approval process, such problems are clearly fatal to the device's consistent operation.

A yet further difficulty experienced by Applicants during their developments, particularly of their cartridges and the base substrates within them which support the globules of formulation, and of the high-concentration nicotine containing formulations themselves, is the degree to which the formulations tended to spread out over the surface of the substrate, i.e. the wettability of the formulations over glass and other inert material substrates. More specifically, Applicants found that simply mixing nicotine at a relatively high concentration with any of the standard excipients or combinations thereof resulted in solutions which had both relatively high surface and interfacial energies such that when a drop or globule was applied to the glass or ceramic substrate, that drop or globule immediately and significantly spread out widely over the substrate surface. When it is considered that the drops or globules of formulation are applied directly to the substrates only on the discrete regions thereof to which have been applied electrically resistive heating elements, the tendency of the drops or globules of formulation to spread away from and beyond the boundaries of such regions not only results in fractionally less of the formulation being directly heated, but that (less) amount of formulation concomitantly receives a greater amount of heat than anticipated, compromising the aerosolization characteristics of any individual heating element and the quantity of formulation resting thereon.

Thus the primary objectives of the present invention are to largely mitigate, if not entirely remedy, such disadvantages.

SUMMARY OF THE INVENTION

According to a first aspect of the present invention, there is provided an aerosolisable formulation comprising Between 25-50%, w/w free-base nicotine, Between 25-40% w/w of one, or some combination of two or more pharmaceutically and biologically safe mono- or di-carboxylic organic acids, Between 50-20% w/w of one or some combination of two or more pharmaceutically and biologically safe liquid excipients, and optionally Between 0-5% w/w water.

Preferably the one or more organic acids is selected from one of the following groups of acids:

Acids containing an aromatic group,

Hydroxycarboxylic acids, being of the α-(alpha), β-(beta) or ω-(omega) variety, or some other variety, Heterocyclic carboxylic acids, aromatic carboxylic acids, Terpenoid acids, Sugar acids, Pectic acids, Amino acids, Cycloaliphatic acids, Aliphatic carboxylic acids, and Keto carboxylic acids.

Preferably, the one or more organic acids present in the formulation is one or more of the following (herein otherwise referred to as "List A"):

1-hydroxy-2-naphthoic acid, 2,2-dichloroacetic acid, 2-hydroxyethanesulfonic acid, 2-oxoglutaric acid, 4-acetamidobenzoic acid, 4-aminosalicylic acid, acetic acid, adipic acid, ascorbic acid (L), aspartic acid (L), benzenesulfonic acid, benzoic acid, camphoric acid (+), camphor-10-sulfonic acid (+), capric acid (decanoic acid), caproic acid (hexanoic acid), caprylic acid (octanoic acid), carbonic acid, cinnamic acid, citric acid, cyclamic acid, dodecyl sulfonic acid, ethane-1,2-disulfonic acid, ethanesulfonic acid, formic acid, fumaric acid, galactaric acid, gentisic acid, glucoheptonic acid (D), gluconic acid (D), glucuronic acid (D), glutamic acid, glutaric acid, glycerophosphoric acid, glycolic acid, hippuric acid, isobutyric acid, lactic acid (DL), lactobionic acid, lauric acid, maleic acid, malic acid (−L), malonic acid, mandelic acid (DL), methanesulfonic acid, naphthalene-1,5-disulfonic acid, naphthalene-2-sulfonic acid, nicotinic acid, oleic acid, oxalic acid, palmitic acid, pamoic acid, propionic acid, pyroglutamic acid (−L), salicylic acid, sebacic acid, stearic acid, succinic acid, tartaric acid (+L), thiocyanic acid, toluenesulfonic acid (p), undecylenic acid.

Most preferably, the one or more acids selected is one of: an Alpha-keto acid (2-oxoacid), a Beta-keto acid (3-oxoacid), and a Gamma-keto acid (4-oxoacid). Alpha-keto acids, such as pyruvic acid, have the keto group adjacent to the carboxylic acid. Beta-keto acids, such as acetoacetic acid, have the ketone group at the second carbon from the carboxylic acid. Gamma-keto acids, such as levulinic acid, have the ketone group at the third carbon from the carboxylic acid.

Most preferably, the formulation includes one of:

Only one of: lactic acid and benzoic acid,

Only lactic acid,

A binary system of two organic acids, one being lactic acid and the other being one of: benzoic acid, salicylic acid, and A binary system of two organic acids, one being lactic acid and the other being chosen from List A above, excepting lactic acid.

In the case where the formulation includes a binary system of two organic acids, one of which is lactic acid, the w/w ratio between the two acids is most preferably 1:1.

In the case where the formulation includes a binary system of two organic acids, one being lactic acid, the second acid is most preferably one of: benzoic acid, salicylic acid.

Most preferably the formulation includes only one acid, being lactic acid.

Preferably the one or more excipients present in the formulation is/are selected from the following: Glycerol, Vegetable Glycerin (VG), Propylene Glycol (PG), Polyethylene Glycol (PEG), & trimethylene glycol (TMG).

Most preferably, the formulation includes only a single excipient, being, most preferably, Glycerol.

In one preferred embodiment, the invention provides a nicotine-containing formulation comprising 25% w/w freebase nicotine 25% w/w of one of: benzoic acid, salicylic acid 50% glycerol.

In another preferred embodiment, the invention provides a nicotine-containing formulation comprising 25% w/w freebase nicotine 16.2% w/w lactic acid solution, said solution consisting of 12% w/w water and 88% lactic acid, 1.8% w/w water, and 58% w/w glycerol.

In yet another preferred embodiment, the invention provides a nicotine-containing formulation comprising 25% w/w freebase nicotine 24.3% w/w lactic acid, 2.7% w/w water, and 48% w/w glycerol.

In yet another preferred embodiment, the invention provides a nicotine-containing formulation comprising 25% w/w freebase nicotine 13.5% w/w lactic acid, 6% w/w of one of: benzoic acid, salicylic acid 1.5% w/w water, and 54% w/w glycerol.

In yet another preferred embodiment, the invention provides a nicotine-containing formulation comprising 25% w/w freebase nicotine 13.5% w/w lactic acid, 5% w/w of one of: benzoic acid, salicylic acid 1.5% w/w water, and 55% w/w glycerol.

In yet another preferred embodiment, the invention provides a nicotine-containing formulation comprising 34% w/w freebase nicotine 16% w/w of a 1:1 molar ratio mixture of lactic acid and benzoic acid, and 50% w/w glycerol.

In yet another preferred embodiment, the invention provides a nicotine-containing formulation comprising:

46.5% w/w freebase nicotine 31.5% w/w of a lactic acid, and

22% w/w polyethylene glycol (PEG).

In yet further preferred embodiment, the invention provides a nicotine-containing formulation comprising:

45% w/w freebase nicotine 32.4% w/w of a lactic acid, and 22.6% w/w polyethylene glycol (PEG).

These last 2 embodiments of the invention are particularly useful, because such formulations are so viscous at room temperature that they handle more like solids than liquids, and indeed these formulations may satisfy the chemical definition of a solid at room temperature. Thus, not only can such formulations be very easily, repeatably, positionally accurately, and volumetrically precisely applied to a base substrate, but such formulations have negligible wetting characteristics once extant on the substrate surface so there is practically no spreading out of the formulations over the surface of the substrate once applied thereto.

According to a further aspect of the present invention, there is provided an aerosolisable formulation comprising Between 26-40%, w/w free-base nicotine, Between 24-40% w/w of one, or some combination of two or more pharmaceutically and biologically acceptable mono- or di-carboxylic organic acids, Between 50-20% w/w of one or some combination of two or more pharmaceutically and biologically acceptable liquid excipients, and optionally Between 0-5% w/w water.

According to a yet further aspect of the present invention, there is provided an aerosolisable formulation comprising Between 25-55%, w/w free-base nicotine, Between 15-35% w/w of one, or some combination of two or more pharmaceutically and biologically acceptable mono- or di-carboxylic organic acids, Between 60-10% w/w of one or some combination of two or more pharmaceutically and biologically acceptable liquid excipients, and optionally Between 0-5% w/w water.

For the avoidance of doubt, all preferred embodiments and dependent features of the first aspect of the present invention detailed above should be considered to apply equally to the second and any further aspects of the present invention, adjusted for the increase (in the aspects of the invention subsequent to the first) in the concentration of freebase nicotine, as the case may be. Such preferred embodiments and dependent features have not been repeated here simply in the interests of brevity.

Applicant has advantageously discovered that the formulations prescribed above, and particularly those containing only lactic acid, an aqueous solution thereof, or a mixture thereof with benzoic acid, again either in pure form or in aqueous solution, all exhibit excellent chemical stability as compared to correspondingly high-concentration nicotine-only formulations, as will become apparent from the following specific description.

Furthermore, Applicant has also discovered that the relatively much lower, more precisely controlled volumetric amounts of aerosols created from the formulations above by Applicant's device can also be inhaled by end users without significantly increased mouth, throat (buccal cavity) and/or lung irritations. Indeed, the mouth, throat and lung sensations are largely similar if not identical in both physical experience and drug delivery to those resulting from the inhalation of very much larger volumetric quantities of aerosols which contain significantly lower concentrations of nicotine from conventional wick-and-coil vaping devices. Thus, even though the effective concentration of nicotine in the new formulations, and especially in the aerosols produced therefrom, is significantly higher than previously ever proposed (at least 25%, and in the resulting aerosol once decomposition of the easily destabilised nicotine salt has occurred, possibly as much as 50% and greater), the existence of the nicotine salt and/or organic acid continues to maintain the palatability (also termed "tolerability") of the inhaled aerosol.

It is also worth noting here that although the prior art formulations, all of which contain significantly lower concentrations of nicotine than those of the present invention but nevertheless (in some cases) slightly higher concentrations than those of the more standard, widely available, nicotine-only containing eLiquids or vape juices, still contain both nicotine and one or more salts of nicotine as in the present invention. However, in the prior art it is the relative "equivalent" or "effective" concentrations of nicotine, being the actual concentration of nicotine present in resulting aerosols, is noticeably considerably lower than in the present invention.

To explain further, it is widely posited, indeed broadly accepted, that aerosolization of the nicotine salt present within the formulation at room temperature or slightly below substantially if not entirely decomposes to the pre-cursor acid and freebase nicotine, the reaction together of which gave rise to the said salt or salts in the first place. Therefore, when any nicotine salt-based formulation is heated to above, preferably at least 100 deg. C., more preferably at least 130 deg. C., and yet further preferably to between 150-180 deg. C., the majority of the salt(s) will have already decomposed, and then it is more the precursor acid from which the salt was formed that aids the palatability/tolerability of the inhaled aerosol. Furthermore, the skilled reader will also understand from the above that the decomposition of the salt concomitantly increases the concentration of freebase nicotine present in the inhaled aerosol, and it is this particular "effective" or "equivalent" concentration that much of the prior art refers to, and which it uses to define particular formulations. Thus, when the prior art is interpreted in the light of the above, resulting in the "equivalent", "effective" or resulting aerosol-borne concentrations of nicotine being in the region of 1-20% w/w, but most commonly between 4-6% w/w, the present invention is quite clearly distinguished because it provides formulations with very much higher effective nicotine concentration levels in the aerosols produced, in some cases at least 40%, in most cases 50%, and in some cases even higher than 50%. Thus merely by heating and then aerosolizing the formulations of the present invention, this effectively doubles the concentration of freebase nicotine as compared to the room-temperature formulations.

There is one further point of chemistry which the skilled reader should be made aware of. Like many reactions, the reaction of nicotine with the majority of organic pharmaceutically acceptable acids of the type mentioned herein and in the prior art is not complete, but more an equilibrium. Thus as temperature increases, the equilibrium shifts more to the (freebase nicotine+acid) side of the reaction, whereas at room temperature (for 1:1 molar acid:nicotine mixing ratios at least), the nicotine salt compound is much more likely to predominate, with relatively very little freebase nicotine being present. The relative concentrations of nicotine and acid (or salt) present in any formulation, together with the temperature, need careful consideration in light of this fact also.

A yet further surprising, unexpected advantage of the formulations of the present invention relates to the effective surface energies (usually in $mJ/m^2$) of the formulations, both as regards the specific surface energy of the formulation itself, and the interfacial energy (again usually in $mJ/m^2$), being a measure of the relative surface energies between the formulation itself and the particular substrate on which the formulation is deposited and by which it is supported. As the skilled reader will understand, the surface and interfacial energies are, in essence, a direct measurement of the degree to which a liquid will "wet", i.e. spread, over the surface of a substrate, and in the context of Applicant's devices, this is an important consideration.

To explain further, many of the most common substrate materials, for example glass and other similar silicates, most common ceramics, soda lime glass and the like, can be regarded as broadly equivalent as far as their specific surface energies are concerned, but Applicant has advantageously and surprisingly discovered that the addition of organic acids to formulations, which in turn contain one or more nicotine salts as a result of the partial or substantial reaction of the acid with freebase nicotine, has a dramatic effect on the surface energy of the formulation as a whole, with the effect that such high-concentration nicotine/nicotine salt formulations, especially those comprising Glycerol or Polyethylene Glycol as the pharmaceutically, biologically acceptable excipient, do not tend to spread out over or "wet" the underlying substrate nearly as much as similar nicotine-only formulations. Indeed, the reduced wetting effect of the novel formulations is so pronounced, even as the formulation is heated towards the aerosolization temperature, that very little spreading or wetting of the substrate occurs at all, and even after multiple repeated aerosolisations have occurred, the remaining globules of formulations on suitable substrates appear to remain entirely static after initial application to said substrate. This is particularly advantageous when it is considered Applicant's devices utilise cartridges substantially encased within which are generally planar substrates of glass to which (a) planar resistive heating elements are applied, and (b) one or more globules of precises amount of formulation are then deposited on the substrate, over, above, and onto the regions of the substrate where said resistive heating elements have been provided. As the skilled reader will easily appreciate, the much reduced tendency of the formulation to spread over the substrate upon and after application is advantageous because now, the novel formulations remain largely if not completely static, in position directly over and above the resistive heater elements which directly, conductively supply heat to the globules of formulation to cause aerosolization thereof. As such the accuracy of aerosolization, and in turn both the volume of aerosol created, and the concentration of nicotine therein can be much more accurately controlled.

It is also to be noted that the cohesiveness (i.e. the opposite of "wetting" and the tendency of the formulation to remain in place on the substrate) can be further improved by either selecting a substrate with lower surface energy or coating the substrate with a suitable (chemically inert) coating composition, which in turn lowers the effective surface energy of the substrate. The known coating composition Parylene has been found to be particularly effective in this regard.

A specific embodiment of the invention is now described by way of example and with reference to the accompanying drawings wherein:

DETAILED DESCRIPTION

Figure 1A:
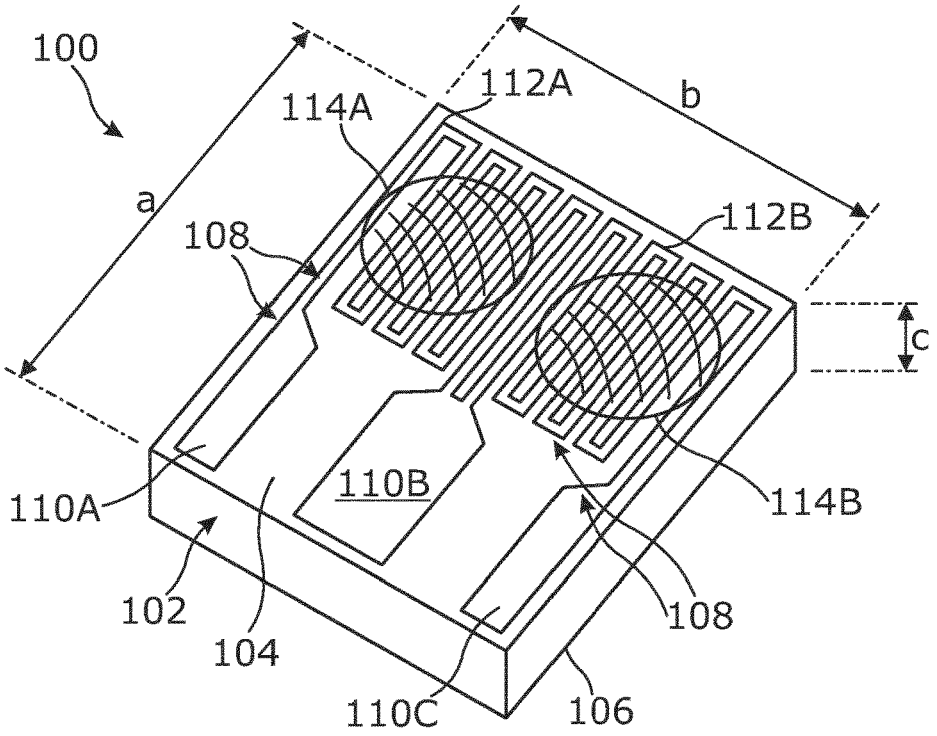
FIG. 1A (Prior Art)
FIGS. 1A, 1B 1C (all prior art) respectively show a perspective view, side and end elevations of a substrate to one surface of which a resistive heating element has been applied, and thereafter onto which globules of formulation have been deposited.
Figure 1B:
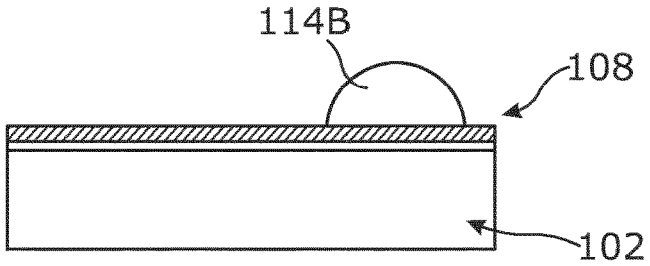
FIG. 1B (Prior Art)
Figure 1C:
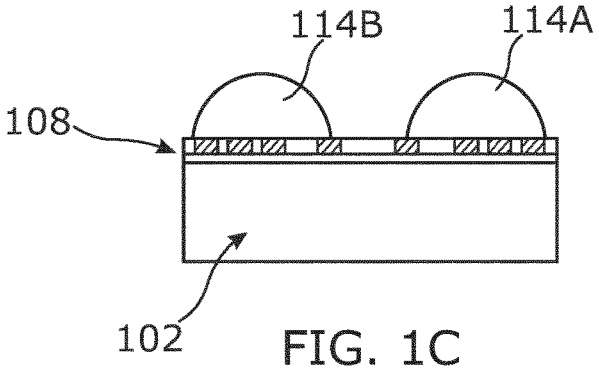
FIG. 1C (Prior Art)

To assist with the understanding of the present invention, particularly as regards the specific surface energy/wetting advantages thereof, the reader's attention is firstly drawn to FIGS. 1A, 1B, 1C, in which there is shown a device indicated generally at 100 and comprising a cuboid substrate 102 of a substantially chemically inert material, such as a silicate, lime, soda or borosilicate glass material though of course other similarly chemically inert materials may be considered, such as for example a ceramic. Ideally, the substrate material is one which is also physically inert that it possesses relatively low thermal conductivity, expansivity, emissivity, and diffusivity characteristics—most glasses fulfil these requirements adequately. To provide some idea of the required dimensions of the device, dimensions a, b, and c are shown, and ideally a and b are of the order of a 5-50 mm, whereas the thickness dimension c is significantly smaller, perhaps of the order of 0.5-5 mm. Substrate 102 possesses upper and lower surfaces 104, 106 respectively, and over the upper surface 104 is applied an electrical conductor indicated generally at 108 which comprises 2 distinct and separate portions, namely contact portions 110A, 110B, 110C, and resistive elements 112A, 112B in which the conductor follows a generally meandering but generally uniform (in that the conductor lengths within the pattern are roughly equal) pattern similar to that of a well-known square wave. In the embodiment depicted, the excitation device comprises only two resistive elements 112A, 112B arranged adjacently at towards the end of the substrate remote from the contact portions, but of course there could be easily be more.

Importantly as far as the present invention is concerned, onto, over, and above each of the resistive elements 112A, 112B there is deposited a suitable amount of formulation. As can be seen from the Figure, each resistive element is at least partially, and preferably substantially covered with respective globules 114A, 114B of said formulation, which can thus be subsequently aerosolised by the underlying elements when they become energised. Globules 114A, 114B can be more clearly seen in FIGS. 1B, 1C, and it is to be noted that in the Figures, the globules are of a formulation having sufficient surface energy so that when coming into contact with the substrate surface, whether coated or otherwise, said globules retain sufficient cohesiveness and thus their globular shape upon the substrate. Also to be noted from the Figures is that globules 114A 114B are entirely separate from one another, as befits the independently controllable excitation elements said globules substantially overlie. As the skilled reader will now understand, any tendency of the formulation to "wet" the substrate, i.e. spread out over the upper surface thereof in generally uncontrollable fashion, as occurred with many if not all nicotine-only containing formulations, is most disadvantageous, because in such circumstances, the formulation would migrate away from and eventually out with the regions where the resistive elements had been applied and were intended to provide their heating effect. Of course, any amounts of formulation which strayed away from the resistive elements would not be subsequently heated at all, or would only be heated very marginally such that aerosolization of said amounts would not likely be achieved, these said amounts being effectively "lost". When the skilled reader understands that the total amounts of formulation being deposited is already very small, any such "loss" would necessarily represent a reduction in the amount of nicotine capable of being delivered to a user, and for a device which is adapted to provide a precise measured dose of nicotine, such a loss must thus be regarded as unacceptable.

Although the present invention should not be considered as being defined with reference to the type of vaping device with which the formulations of the present invention are intended to be used, it should nevertheless be understood by the skilled reader that the said formulations have been specifically adapted for use only with a specific type of "cartridge-based" vaping device into which the substrate of FIGS. 1A-1C is ultimately inserted. As the name suggests, such devices are adapted to receive a replaceable cartridge which is inserted into or otherwise connected to the device either from the first use of the device or after a cartridge extant within the device, exhausted through use, has been removed to be discarded or recycled. As the skilled reader will be aware, there are already a great many cartridge based vaping devices in existence, sometimes described as "pod mods", but what practically all these devices have in common is that the "pod" or cartridge they receive is, in essence, a reservoir for an amount (usually about 0.5-2 ml) of a nicotine-containing formulation. Although most modern cartridge-based devices are "closed" systems wherein the cartridge or pod is not intended or adapted to be refilled by a user, some of the larger "pod mod" devices do accept removable cartridges which can be manually refilled. The reader will understand that such devices are essentially no different at all to the more common and conventional "reservoir-based" devices, which include a manually refillable reservoir component (of slightly larger volumetric capacity, e.g. 1-5 ml) which can be topped up by a user with any (usually, but not necessarily) nicotine-containing liquid formulation, flavoured or otherwise, as and when required. Typically, the reservoir is refilled when it is or approaches empty after whatever formulation therein is progressively depleted as the device is used—depending on the frequency of use, this may be daily for a heavy smoker or weekly for a light, infrequent or social smoker.

The important distinction to be made here is that whereas reservoir-based devices and refillable cartridge-based devices offer practically no end-user control in terms of the formulations used therein and thus the amount of nicotine ultimately delivered to a user, closed system cartridge-based devices such those being developed by Applicant offer a much greater degree of control. Fundamentally, this is because each cartridge will not only be accurately and precisely pre-dosed with a specific formulation containing nicotine (and a suitable acid) at a desired concentration, but also the cartridge itself will be specifically designed and thus suited for use only within a correspondingly designed vaping device, and thus the delivery of whatever concentration of nicotine is present in the formulation can be much more carefully regulated.

Turning now to the invention itself, and the nicotine and nicotine-salt (arising from the reaction of the weak base nicotine with an acid) containing formulations, Applicant has tested various formulations and found that the most useful, in terms of chemical stability at least, contain nicotine itself, a pharmaceutically/biologically acceptable such as glycerol (or any other such composition or mixtures thereof previously mentioned), and one or more of the following:

Only Lactic acid, or an aqueous solution thereof,

A binary system of lactic and benzoic acid, either in their pure form or in appropriate aqueous solutions, and A binary system of lactic and salicylic acid, either in their pure form or in appropriate aqueous solutions.

Specific stability studies conducted by Applicant are set out and summarised below:

Stability Study (Benzoic Acid):

The primary purpose of this study was to evaluate the stabilising effect of Benzoic Acid when added to nicotine formulations which also contain glycerol. The secondary purpose of the study was to investigate the interday and inter 'analyst' accuracy in the manufacture and analysis of two formulations containing different concentrations of Benzoic acid (see below, 5%, 25% w/w respectively). Both of these formulations have previously demonstrated positive chemical stability data after 8 weeks storage. This study involved the manufacture of two batches of each formulation, i.e. one having 5% w/w Benzoic Acid and the other having 25% w/w Benzoic Acid, by four individuals (hereinafter anonymised as simply $A_5$ or $A_{25}$, $B_5$ or $B_{25}$, $C_5$ or $C_{25}$, and $D_5$ or $D_{25}$ as appropriate, and as referenced in FIG. 2 hereof) over two different days. As such, 8 batches of formulation were manufactured in total.

In process checks (IPC) were conducted on the formulations manufactured to check they contained the correct amount of nicotine, at various stages, using high pressure liquid chromatography (hplc). For the purpose of this study, one "dose" is considered to be the volumetric quantity of a single globule of formulation applied to the test substrate and which contains 0.5 mg of nicotine. As such the amount of formulation used on each test substrate (or per inhalation cartridge) will be greater for the lower concentration nicotine formulation (see formulation specifics below).

Formulation Summary

Formulations were manufactured according to the table below for batch sizes of 50 g:

TABLE 1

Formulation Summary

| Formulation | Nicotine (g) | Benzoic Acid (g) | Glycerol (g) | Mass of the formulation to dose (0.5 mg) |
|---|---|---|---|---|
| 5% Benzoic Acid Solution | 22.50 g | 2.50 g | 25.00 g | 1.12 mg |
| 25% Benzoic Acid Solution | 12.50 g | 12.50 g | 25.00 g | 2.0 mg |

Results

TABLE 2

Summary of data from stability study in tabular format, for the formulation containing only 5% w/w Benzoic Acid Concentration, and for that containing 25% w/w Benzoic Acid. Nicotine Recovered (%)

| Time Point (weeks/ moment) | Days | (A) 5% | (B) 5% | (C) 5% | (D) 5% | (D) 25% | (B) 25% | (A) 25% | (C) 25% |
|---|---|---|---|---|---|---|---|---|---|
| T0 W | 0 | 100 | 100 | 100 | 100.00 | 100 | 100 | 100 | 100 |
| T1 W | 7 | 96.6 | 91.6 | 96.8 | 93.70 | 96.7 | 100.1 | 101.9 | 101.1 |
| T2 W | 14 | 89.6 | 87.1 | 89.3 | 95.30 | 101 | 98.7 | 99.8 | 99 |
| T3 W | 21 | 89.9 | 83.7 | 90.9 | 94.30 | 102.1 | 101.5 | 101.3 | 98.4 |
| T4 W | 28 | 92.2 | 89.1 | 92.7 | 82.30 | 101.1 | 101.2 | 99.5 | 101 |
| T2 M | 56 | 89.9 | 83.8 | 91 | 86.00 | 98.8 | 99.5 | 98.2 | 98.2 |
| T3 M | 84 | 92.2 | 87.7 | 91.4 | 93.80 | 99.8 | 99.6 | 99.0 | 98.2 |
| T6 M | 182 | 83.7 | 81.2 | 84.7 | 74.2 | 98.4 | 99.0 | 99.9 | 98.3 |

Figure 2:
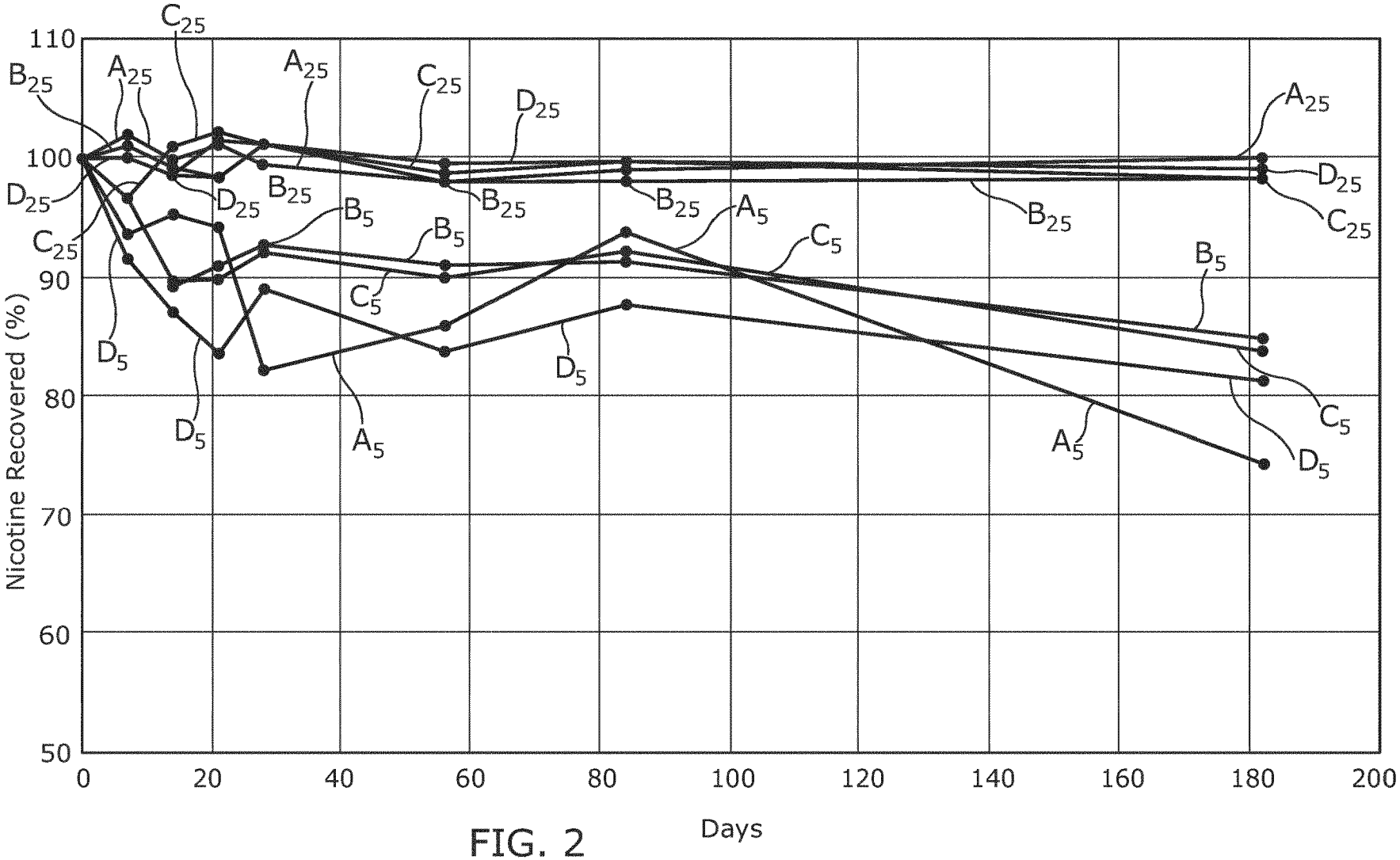
FIG. 2 shows a graph illustrating the difference in stability over a 6 month time period of two different nicotine-containing formulations, one containing only 5% w/w benzoic acid and the other containing 25 w/w % benzoic acid, each being prepared by 4 different individuals A, B, C, D, and FIG. 3, similar to FIG. 2 above, illustrates the relative stabilities of formulations including different concentrations of lactic acid (as opposed to benzoic acid) over a similar 6 month time period.

The data above is usefully illustrated in Graphical form in FIG. 2 hereof, wherefrom it can be instantly seen that all of the four individually prepared formulations which contained 25% w/w benzoic acid (graph lines specifically referenced at $A_{25}$, $B_{25}$, $C_{25}$, $D_{25}$) markedly outperform, as far as chemical stability is concerned, the formulation containing only 5% w/w/ benzoic acid (graph lines specifically referenced at $A_5$, $B_5$, $C_5$, $D_5$). Indeed, after 6 months, the 25% w/w benzoic acid formulations lost practically no nicotine at all, with all still showing nicotine retention levels at over 98% as compared to the concentrations thereof in the initial formulations.

Conclusion of Stability Test:

The data generated on the stability study clearly demonstrates product stability for benzoic acid containing formulations (25% w/w Benzoic Acid) for up to six months, with no appreciable change in the recovery of nicotine. The data generated on the stability study demonstrates that product stability for the formulations containing only 5% benzoic acid stability has not been attained with an average loss of nicotine of 3.2% per month.

Stability Study (Lactic Acid).

Applicants conducted a broadly similar stability study for formulations comprising lactic acid. Details the various formulations tested are provided in the table below:

Formulation Summary

TABLE 3

Lactic Acid Formulation Summary

| Formulation Name/Ref | Lactic Acid (w/w %) | Nicotine (w/w %) | Excipient (Name, w/w %) | Flavour (Name, w/w %) |
|---|---|---|---|---|
| Arm 1 | 18 | 25 | Glycerol, 57 | NONE, 0 |
| Arm 3 | 32.4 | 45 | PEG 3000, 22.6 | NONE, 0 |
| Arm 4 | 29 | 41 | PEG 200, 20 | Menthol, 10 |
| Arm 6 | 41.4 | 58.6 | NONE, 0 | NONE, 0 |
| Arm 7 | 37.3 | 52.7 | NONE, 0 | Menthol, 10 |
| Control | 18 | 25 | Glycerol, 57 | NONE, 0 |

Figure 3:
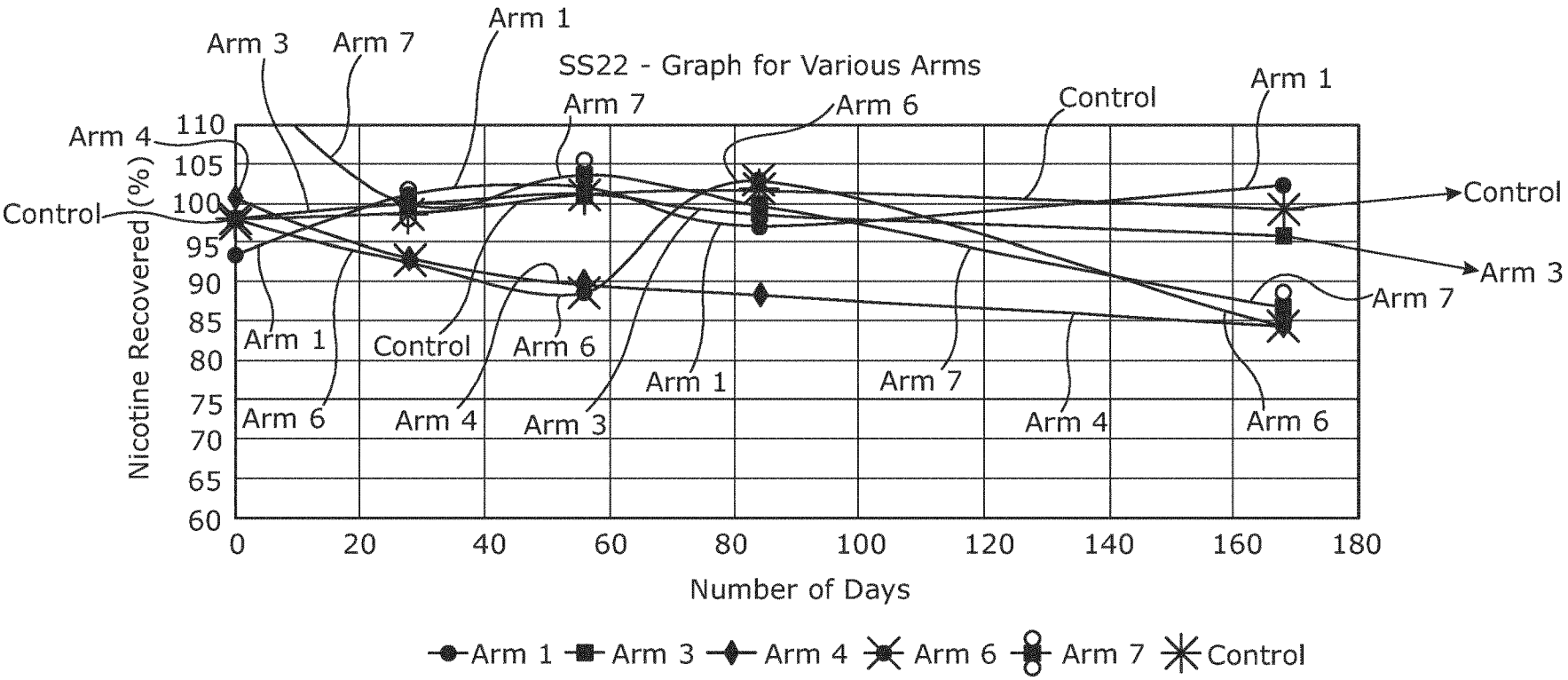

The Stability test data, derived in a broadly identical manner as that for the Benzoic Acid Stability Study, are plotted in the Graph provided in FIG. 3 hereof, with data for each of the above formulations being clearly identified. From this Figure, it can be seen that of the 6 different formulations above, three had markedly improved stability over approximately 5-6 months, these being "Arm 1", "Arm 3" (the most preferred of all the formulations), and "Control". "Arm 3" in particular is considered most useful on account of its inherent viscosity and low wettability.

Thus, Applicant has experimentally confirmed that useful and advantageous formulations can be created, provided that the relative concentrations of the acid (or acids in binary systems), in toto, amount to at least about 15% w/w, and preferably at least about 20%, and yet further preferably at least about 25% w/w, while nicotine concentrations remain high at at least about 25% w/w, and in most preferred embodiments more than about 30% w/w, and in yet further preferred embodiments as much as about 40-50% w/w, and even, in some embodiments, as much as about 55-60%, as prescribed by the present invention.

It should be mentioned here that although Applicant has done significant testing of formulations including only benzoic acid, some mild concerns have been raised that benzoic acid in an inhalable aerosol could give rise to some toxicology concerns, particularly in terms of its Specific target organ toxicity (STOT) and irritant qualities. It is therefore much preferred to use either lactic acid alone in place of benzoic acid in the formulations, or to use a binary system of acids, one being lactic acid, and the other selected from the list provided above (ideally salicylic acid), not being benzoic acid.

Applicant's detailed investigations have found a most preferred formulation to be comprised of, specifically, About 45-46%, w/w free-base nicotine, About 31-33% w/w of lactic acid, and About 24-21% w/w of polyethylene glycol (PEG) as excipient, specifically a high molecular weight PEG compound such as PEG 3000.

In the above (and other) formulations falling within the scope hereof, the skilled reader should understand that the excipient employed within the formulations may be any one or some combination of the various excipients disclosed and described herein. Thus, for example, in the above most preferred formulation, the excipient may be changed to a Glycerol, a Glycerin, or some other glycol, or any combination of such.

Specifically, the formulation referenced as "Arm 3" in the above and in FIG. 3 is currently Applicant's most preferred formulation.

The skilled reader should understand from the above, and in particular use of the word "about" both therein and elsewhere in this specification, that Applicant does not intend the percentage figure following the word "about" to be precise and exact such that any percentage value above or below the number, or outside any range qualified by said word, would be considered outside the scope hereof. Instead reader should understand that the word "about" imparts an approximation to the relevant figure or range, of "about" 1%-2% of that or those numbers immediately following, and thus being qualified by the said word "about".

The invention claimed is:

1. An aerosolisable formulation comprising
Between about 25-50%, w/w free-base nicotine,
Between about 15-35% w/w of lactic acid, or some combination of lactic acid and one or more pharmaceutically and biologically acceptable mono- or di-carboxylic organic acids,
Between about 60-10% w/w of one or some combination of two or more-pharmaceutically and biologically acceptable liquid excipients, and optionally
Between about 0-5% w/w water.

2. A formulation according to claim 1 wherein the formulation comprises between about 15-35% of a combination of lactic acid and one or more mono- or di-carboxylic organic acids selected from one of the following groups of acids:
Acids containing an aromatic group,
Hydroxycarboxylic acids,
Heterocyclic carboxylic acids,
aromatic carboxylic acids,
Terpenoid acids
Sugar acids,
Pectic acids,
Amino acids,
Cycloaliphatic acids,
Aliphatic carboxylic acids, and
Keto carboxylic acids.

3. A formulation according to claim 1 wherein the formulation comprises between about 15-35% of a combination of lactic acid and one or more of the following mono- or di-carboxylic organic acids: 1-hydroxy-2-naphthoic acid, 2,2-dichloroacetic acid, 2-hydroxyethanesulfonic acid, 2-oxoglutaric acid, 4-acetamidobenzoic acid, 4-aminosalicylic acid, acetic acid, adipic acid, ascorbic acid (L), aspartic acid (L), benzenesulfonic acid, benzoic acid, camphoric acid (+), camphor-10-sulfonic acid (+), capric acid (decanoic acid), caproic acid (hexanoic acid), caprylic acid (octanoic acid), carbonic acid, cinnamic acid, citric acid, cyclamic acid, dodecyl sulfonic acid, ethane-1,2-disulfonic acid, ethanesulfonic acid, formic acid, fumaric acid, galactaric acid, gentisic acid, glucoheptonic acid (D), gluconic acid (D), glucuronic acid (D), glutamic acid, glutaric acid, glycerophosphoric acid, glycolic acid, hippuric acid, isobutyric acid, lactic acid (DL), lactobionic acid, lauric acid, maleic acid, malic acid (−L), malonic acid, mandelic acid (DL), methanesulfonic acid, naphthalene-1,5-disulfonic acid, naphthalene-2-sulfonic acid, nicotinic acid, oleic acid, oxalic acid, palmitic acid, pamoic acid, propionic acid, pyroglutamic acid (−L), salicylic acid, sebacic acid, stearic acid, succinic acid, tartaric acid (+L), thiocyanic acid, toluenesulfonic acid (p), undecylenic acid.

4. A formulation according to claim 1 wherein the formulation comprises between about 15-35% of a combination of lactic acid one or more of the following mono- or di-carboxylic acids: an Alpha-keto acid (2-oxoacid), a Beta-keto acid (3-oxoacid), and a Gamma-keto acid (4-oxoacid).

5. A formulation according to claim 1 wherein the formulation includes:
A binary system of two organic acids, one being one of lactic acid and the other being one of: benzoic acid, salicylic acid.

6. A formulation according to claim 5 wherein the formulation includes a binary system of two organic acids, one of which is lactic acid, and the molar ratio between the two acids is about 1:1, and the overall combined w/w percentage of acid in the formulation is at least about 25% w/w.

7. A formulation according to claim 1 wherein the one or more excipients present in the formulation is/are selected from the following: Glycerol, Vegetable Glycerin (VG), Propylene Glycol (PG), Polyethylene Glycol (PEG), and trimethylene glycol (TMG).

8. A formulation according to claim 1 which includes only a single excipient component, being one of Glycerol and Polyethylene Glycol.

9. A formulation according to claim 1 comprising
about 25% w/w freebase nicotine
about 24.3% w/w lactic acid,
about 2.7% w/w water, and
about 48% w/w glycerol.

10. A formulation according to claim 1 comprising
about 25% w/w freebase nicotine
about 13.5% w/w lactic acid,
about 5% w/w of one of: benzoic acid, salicylic acid
about 1.5% w/w water, and
about 55% w/w glycerol.

11. A formulation according to claim 1 comprising
about 34% w/w freebase nicotine
about 16% w/w of a 1:1 molar ratio mixture of lactic acid and benzoic acid, and
about 50% w/w glycerol.

12. A formulation according to claim 1 comprising
about 45-46%, w/w free-base nicotine,
about 31-33% w/w of lactic acid,
about 24-21% w/w polyethylene glycol.

13. A formulation according to claim 12 wherein the polyethylene glycol is a high molecular weight polyethylene glycol compound having a molecular weight of 3000.

14. An aerosolisable formulation comprising
Between about 25-50%, w/w free-base nicotine,
Between about 25-40% w/w of lactic acid, or some combination of lactic acid and one or more pharmaceutically and biologically acceptable mono- or di-carboxylic organic acids,
Between about 50-20% w/w of one or some combination of two or more pharmaceutically and biologically acceptable liquid excipients, and optionally
Between about 0-5% w/w water.

15. An aerosolisable formulation comprising
about 25% w/w freebase nicotine,
about 16.2% w/w of an aqueous lactic acid solution comprising 88% lactic acid,
about 58% w/w Glycerol,
with the remainder of the formulation being water.

16. An aerosolisable formulation comprising
Between about 25-50%, w/w free-base nicotine,
Between about 15-35% w/w of one, or some combination of two or more of the following mono- or di-carboxylic acids: an Alpha-keto acid (2-oxoacid), a Beta-keto acid (3-oxoacid), and a Gamma-keto acid (4-oxoacid),
Between about 60-10% w/w of one or some combination of two or more pharmaceutically and biologically acceptable liquid excipients, and optionally
Between about 0-5% w/w water.

17. An aerosolisable formulation comprising
about 25% w/w free-base nicotine,
about 25% w/w of one of: benzoic acid, salicylic acid,
about 50% glycerol, and optionally
between about 0-5% w/w water.

* * * * *